United States Patent [19]

Matsuzaka et al.

[11] Patent Number: 4,507,386

[45] Date of Patent: Mar. 26, 1985

[54] SILVER HALIDE PHOTOGRAPHIC EMULSION

[75] Inventors: Syoji Matsuzaka, Hino; Makoto Kajiwara; Masanobu Miyoshi, both of Odawara; Kiyoshi Yamashita, Hino, all of Japan

[73] Assignee: Konishiroku Photo Industry Co., Ltd., Tokyo, Japan

[21] Appl. No.: 530,020

[22] Filed: Sep. 7, 1983

[30] Foreign Application Priority Data

Sep. 13, 1982 [JP] Japan ..... 57-160699

[51] Int. Cl.[3] ..... G03C 7/26

[52] U.S. Cl. ..... 430/549; 430/552; 430/554; 430/556; 430/567; 430/569

[58] Field of Search ..... 430/552, 554, 556, 567, 430/569, 549

[56] References Cited

U.S. PATENT DOCUMENTS

| | | | |
|---|---|---|---|
| 3,206,313 | 9/1965 | Porter et al. | 430/569 |
| 3,317,322 | 5/1967 | Porter et al. | 430/599 |
| 3,367,778 | 2/1968 | Berriman | 430/598 |
| 4,395,478 | 7/1983 | Hoyen | 430/217 |
| 4,414,306 | 11/1983 | Wey et al. | 430/569 |
| 4,414,310 | 11/1983 | Daubendiek et al. | 430/567 |

*Primary Examiner*—J. Travis Brown

*Attorney, Agent, or Firm*—Frishauf, Holtz, Goodman & Woodward

[57] ABSTRACT

A silver halide photographic emulsion containing a coupler for photography, comprising silver halide particles in said emulsion consisting essentially of 2 mole % or less of silver iodide, 50 to 97 mole % of silver bromide and 1 to 50 mole % of silver chloride, and said particles are core/shell type silver halide particles containing a higher content of said 50 to 97 mole % silver bromide in the surface layers of said particles than in the inner portions thereof, the surface layer of said particles containing 70 to 100 mole % of silver bromide and the inner portion containing 40 to 70 mole % of silver bromide.

17 Claims, No Drawings

SILVER HALIDE PHOTOGRAPHIC EMULSION

This invention relates to an emulsion for photography (hereinafter called briefly as emulsion) improved in coating liquid stability and developing characteristic, and a photographic light-sensitive material (hereinafter called briefly as sensitive material), particularly to a print paper sensitive material for color photography.

A sensitive material for forming yellow, magenta and cyan dye images, respectively, in blue-, green- and red-sensitive silver halide emulsion layers is known in the art, and a typical example thereof is disclosed in U.S. Pat. No. 3,416,923.

Such a light-sensitive color photographic material (hereinafter called briefly as color sensitive material) as mentioned above can give a good multi-color photographic recording, but it has been desired to have a color sensitive material further decreased in fog and improved in developing characteristic.

Particularly, in recent years, with the increased demand for color sensitive materials and therefore increased amounts of processing, rapid processing is becoming highly desirable and the development processing tends to be practiced at higher temperature with smaller number of baths.

On the other hand, in sensitive materials requiring a rapid developing step, a silver chlorobromide emulsion having good developing characteristic is employed as the silver halide emulsion constituting the sensitive material. And, while it is known that a sensitive material with better developing characteristic can be obtained when employing a silver chlorobromide emulsion with higher content of silver chloride, such a silver chlorobromide with high silver chloride content is poor in storage stability, particularly storage stability in liquid state in a solution containing a coupler dispersion for photography, whereby deterioration of the coating liquid, particularly increase in fog, occurs before coating of the emulsion of the coupler emulsion on a support to make it difficult to produce stably sensitive materials with low fog.

It is also known to use an emulsion produced by the conversion method, but it is great in pressure desensitization, and it has been desired to have countermeasures to cope with such a phenomenon.

A first object of this invention is to provide an emulsion for color photography which can constitute a color sensitive material small in fog, based on such desires and trends as mentioned above.

A second object of this invention is to provide an emulsion for color to be used for constitution of a color sensitive material which can be adapted for rapid treatment.

Further, a third object of this invention is to provide a sensitive material having good pressure densitization resistance.

The above objects of this invention can be accomplished by a silver halide photographic emulsion containing a coupler for photography, wherein silver halide particles in said emulsion are composed of 2 mol % or less of silver iodide, 50 to 97 mole % of silver bromide and 1 to 50 mole % of silver chloride, and are core/shell type silver halide particles containing the silver bromide in a higher content in the surface layers of said particles than in the inner portions thereof.

Preferably, the above 50 to 97 mole % of silver bromide is contained in the core/shell type silver halide particles in such a manner that the surface layer of the particles contains 70 to 100 mole % of the silver bromide and the inner portion contains 40 to 70 mole % of the same.

It is also preferable for the core/shell type silver halide particles to have the shell thickness of 0.01 to 0.2 μm.

The present inventors have studied extensively along the objects as mentioned above and consequently found that, by use of an emulsion in which the silver halide emulsion is constituted of a silver chloroiodobromide having 2 mole % or less of silver iodide, said emulsion having the so-called core/shell structure, in which the content of silver chloride content in the crystal surface layers in the silver chlorobromoiodide microcrystals is lower than in inner portions of the crystals, namely more enriched in silver bromide in the surface layers than in the internal portions, the deterioration of the storage stability under the state of a solution containing the above-mentioned coupler dispersion can be improved. Further, such an effect of improvement in storage stability has been found to be obtained, particularly when such core/shell type crystal grains have a narrow grain size distribution, namely a so-called mono-dispersed emulsion.

The mono-dispersed emulsion herein mentioned refers to an emulsion having a coefficient of variance of 15% or less, when the distribution of the grain sizes of the silver halide microcrystals constituting the emulsion is determined. The coefficient of variance is a coefficient indicating broadness of the grains size distribution and defined by the following formula:

$$\text{Coefficient of variance} = \frac{\text{Standard deviation of grain size}}{\text{Mean grain size}} \times 100\ (\%)$$

The silver chlorobromoiodide of this invention can be obtained according to the simultaneous mixing method, in which an aqueous solution of a water soluble silver salt and an aqueous solution of a water soluble halide (a mixed solution of chloride, bromide and iodide at proportions corresponding to the composition of silver chlorobromoiodide) are added and mixed at the same time. For example, there may be conveniently employed the simultaneous mixing method, in which pAg is controlled precisely and stably by controlling the proportions between the halides supplied as the source for formation of silver halide and adding at the same time a solution of halide for controlling of pAg.

More specifically, the above preparation method may preferably be the method disclosed in Japanese Patent Application (7), filing No. 157170/1982, filed on Sept. 8, 1982, entitled: "Silver halide photographic emulsion and method for preparing the same", which is suitable for preparation of the emulsion containing core/shell type silver halide grains.

The emulsion of this invention has a structure with higher content of silver bromide in the crystal surface layer of silver chlorobromoiodide crystal than in the inner portion of the crystal, but it is different from the conversion method emulsion as disclosed in Japanese Patent Publication No. 36978/1975. The conversion method emulsion herein mentioned refers to an emulsion comprising silver halide grains prepared by forming silver salt grains of which at least a part constituting the preceding precipitates is greater in solubility in water than silver bromide, and subsequently converting at least a part of such grains into silver bromide or silver iodobromide. This is a method, in which after formation of silver chloride or silver chlorobromide microcrystals, by adding an aqueous solution of a readily soluble bromide or a mixture of bromide and iodide to an emulsion, the chloride ions in the previously formed silver chloride or silver chlorobromide microcrystals are substituted with bromide ions and/or iodide ions by utilization of the difference in solubility product between silver salts, whereby silver chlorobromide with higher silver bromide is obtained. According to this method, since the bromide ions and/or iodide ions added later will substitute the already existing chloride ions in crystals, the grain sizes of crystals (stoichiometric) are not substantially changed, but form a crystalline phase in which the content of silver bromide is lowered from the crystal surface toward the inner portion of the crystal. Also, chloride ions equimolar to substituted bromide ions and/or iodide ions are liberated into the solution.

In contrast, in the core/shell emulsion of this invention, the crystalline phase with higher silver bromide is precipitated, laminated and grown on the already existing crystal surfaces. This is because silver ions equimolar to bromide ions and/or iodide ions are constantly added, whereby the reaction occurs far more readily with silver ions in the solution precipitating on the crystal surfaces than the reaction in which chloride ions are substituted by extraction from the crystal lattices in the crystals in which bromide ions and/or iodide ions already exist. (In the conversion method emulsion, no silver ion is added into the solution, and therefore there occurs the reaction in which chloride ions are substituted through extraction).

Thus, in the core/shell type emulsion, since the crystalline phase with higher silver bromide content is precipitated on the already existing crystal surfaces, the crystal grain sizes are greater by such existing sizes. There is no liberation of chloride ions into the solution.

Thus, the conversion method emulsion and the core/-shell type emulsion of this invention differ in the reaction when forming the silver chlorobromide crystals constituting the emulsion. As a result, the crystals formed also differ in photographic performance. The conversion method emulsions exhibit similar properties because of higher silver bromide content near the crystal surfaces similarly as the core/shell emulsions of this invention, but differ greatly in pressure desensitizing characteristic. The pressure desensitizing characteristic is the property of a sensitive material to be desensitized by presure, that is a phenomenon in which the portion applied with pressure in the exposure or developing step of a sensitive material white values, which phenomnon is not desirable in sensitive materials frequently subjected to production steps or photographing steps with many chances of pressure. This phenomenon seems to be due to disturbance of the crystal lattices during the halide ion converting reaction. Thus, the conversion emulsion is greater in pressure desensitization.

The light-sensitive silver halide emulsion may be applied with doping with various metal salts or metal complex salts during formation of silver halide emulsion, grain growth or after completion of growth. For example, it is possible to apply metal salts or complex salts of gold, platinum, palladium, iridium, rhodium, bismuth, cadmium, copper, etc. or combinations thereof.

Also, excessive halide compounds formed during preparation of the emulsion of this invention or by-produced or unnecessary salts or compounds such as nitrates, ammonia may be removed. The method for removal may be suitably, for example, Noodel water washing method, dialyzing method or coagulation precipitation method.

The emulsion of this invention can also be applied with various chemical sensitizing methods to be applied for emulsions in general. That is, it can be sensitized with a chemical sensitizer such as active gelatin; noble metal sensitizer such as water soluble gold salt, water soluble platinum salt, water soluble palladium salt, water soluble rhodium salt, water soluble iridium salt and the like; sulfur sensitizer; selenium sensitizer; polaamine, stannous chloride, etc.; either singly or in combination. Further, this silver halide can be optically sensitized to a desired wavelength region. The method for optical sensitization of the emulsion of this invention is not particularly limited, but optical sensitization may be effected by using, for example, cyanine dyes such as zeromethyne dye, monomethyne dye, dimethyne dye, trimethyne dye and the like or melocyanine dyes singly or in combination (e.g. ultra-color sensitization). These techniques are disclosed also in U.S. Pat. Nos. 2,688,545; 2,912,329; 3,397,060; 3,615,635; and 3,628,964; U.K. Pat. Nos. 1,195,302; 1,242,588; and 1,293,862; German Pat. (OLS) Nos. 2,030,326; and 2,121,780; Japanese Patent Publication Nos. 4936/1968 and No. 14030/1969. Its choice may be determined as desired depending on the wavelength region to be sensitized, sensitivity, the purpose or use of the sensitive material.

The mono-dispersed silver halide emulsion of this invention may be provided for use as is, or two or more kinds of mono-dispersed emulsions with different mean grain sizes may be blended at any stage after formation of grains so as to obtain a desired tone before being provided for use. However, other silver halide grains may also be included in the emulsion of this invention within the range which does not interfere with the effect of this invention.

Also, when the emulsion of this invention is to be applied for a sensitive material for color photograph, there may be employed the method and materials conventionally used for color sensitive materials such as incorporation of a combination of cyan, magenta and yellow couplers in the emulsion of this invention controlled to red-sensitive, green-sensitive and blue-sensitive. For example, there may be included open-chain methylene type yellow couplers, 5-pyrazolone type magenta couplers, phenol type or naphthol type cyan couplers. These couplers may be the so-called di-equivalent type or tetra-equivalent type couplers, or diffusive dye releasing type couplers may also be used in combination with these couplers. Further, it is also possible to incorporate couplers called as the competing coupler, DIR coupler (Development Inhibitor Releasing Coupler) or BAR coupler (Bleach Accelerator Receleasing Coupler) in combination with various couplers in order to improve photographic characteristics. As the yellow coupler, there may be employed conventionally used open-chain ketomethylene compounds, further those called as di-equivalent type couplers such as active point-o-aryl substituted coupler, active point-o-acyl substituted coupler, active point hydantoin compound substituted coupler and active point urazole compound substituted coupler and active point succinic acid imide compound substituted coupler, active point chlorine or bromine substituted coupler, active point-o-sulfonyl substituted coupler, as effective yellow couplers.

As the magenta coupler to be used in this invention, there are pyrazolone type, pyrazolotriazole type, pyrazolinobenzimidazole type, and indazolone type compounds.

These magenta couplers may be not only tetra-equivalent couplers but also di-equivalent couplers similarly as in case of yellow couplers.

Further, useful cyan couplers to be used in this invention include, for example, phenol type, naphthol type couplers, etc. And, these cyan couplers may be not only tetra-equivalent couplers but also di-equivalent couplers similarly as in the case of yellow couplers.

In order for these couplers to be incorporated in the photographic emulsion of this invention, when said couplers are alkali soluble, they may be added as alkaline solutions; when they are oil soluble, they may be preferably dissolved in a high boiling solvent, optionally together with a low boiling solvent, and dispersed as minute particles in silver halide emulsions, as described in U.S. Pat. Nos. 2,322,027; 2,801,170; 2,801,171; 2,272,191 and 2,304,940. If desired, during this operation, other hydroquinone derivatives, UV-ray absorbers or antifading agents may also be used in combination. Also, two or more kinds of couplers may be used as a mixture. To describe in further detail about the preferable method for adding couplers, one kind or two or more kinds of couplers, optionally together with other couplers, hydroquinone derivatives, antifading agents or UV-ray absorbers, are dissolved in a high boiling solvent, as exemplified by organic acid amides, carbamates, esters, ketones, urea derivatives, specifically di-n-butyl phthalate, tricresyl phosphate, triphenyl phosphate, di-isooctyl azelate, di-n-butyl sebacate, tri-n-hexyl phosphate, N,N-di-ethylcaprylamide butyl, N,N-diethyllaurylamide, N-pentadecylphenyl ether, di-octylphthalate, n-nonylphenol, 3-pentadecylphenyl ethyl ether, 2,5-di-sec-amylphenyl butyl ether, monophenyl-o-chlorophenyl phosphate or fluorinated paraffins and/or a low boiling solvent such as methyl acetate, ethyl acetate, propyl acetate, butyl acetate, butyl propionate, cyclohexanol, diethyleneglycol monoacetate, nitromethane, carbon tetrachloride, chloroform, cyclohexane, tetrahydrofuran, methyl alcohol, acetonitrile, dimethylformamide, dioxane, methyl ethyl ketone and so on, and the resultant solution is mixed with a solution containing an anionic surfactant such as alkylbenzenesulfonic acid and or a nonionic surfactant such as sorbitane sesqui-oleic acid ester and sorbitane monolauric acid ester and/or a hydrophilic binder such as gelatin, followed by emulsification by means of a high speed rotary mixer, colloid mill or a sonication dispersing means, and thereafter the resultant emulsion is added to the silver halide emulsion.

The couplers may also be dispersed by use of the latex dispersing method. The latex dispersing method and its effect are well described in, for example, Japanese Unexamined Patent Publication Nos. 74538/1974, 59943/1976 and 32552/1979, and Research Disclosure No. 14850, pp. 77–79, August, 1976.

Suitable latices are those of, for example, homopolymers, copolymers and terpolymers of monomers such as styrene, ethyl acrylate, n-butyl acrylate, n-butyl methacrylate, 2-acetoacetoxyethyl methacrylate, 2-(methacryloyloxy)ethyltrimethylammonium methosulfate, sodium 3-(methacryloyloxy)propane-1-sulfonate, N-isopropylacrylamide, N-[2-(2-methyl-4-oxopentyl)]acrylamide, 2-acrylamide-2-methylpropane sulfonic acid and the like.

The amount of the coupler added is not limited but preferably 10 to 100 g per mole of silver halide.

In the photographic emulsion of this invention, it is advantageous to use as a UV-ray absorber a thiazoline, benzotriazole, acrylonitrile or benzophenone type compound for the purpose of prevention of fading of the dye by the active rays with short wavelengths. In particular, Tinuvin PS, 320, 326, 327 and 328 (each produced by Ciba-Geigy Co.) may be advantageously used either singly or in combination.

The hydroquinone derivatives to be used together with the above-mentioned couplers in the photographic emulsion of this invention are also inclusive of the precursors thereof. The precursors mentioned herein mean the compounds capable of liberating hydroquinone derivatives through hydrolysis.

Preferable examples of the above-mentioned antifading agents are curomane type compounds, cumarane type compound and spirocuromane type compounds.

As the binder in the photographic emulsion of this invention, gelatin as well as other various hydrophilic colloids may be employed. As the gelatin to be used as the binder, not only gelatin but also gelatin derivatives are included. Gelatin derivarives may include the reaction products of gelatin with acid anhydrides, the reaction products of gelatin with isocyanates or the reaction products of gelatin with compounds having active halogen atoms.

In addition to the above-mentioned gelatin derivatives, if necessary, colloidal alubumin, agar, gum arabic, dextran, alginic acid, cellulose derivatives such as those hydolyzed to an acetyl content of 19 to 26%, polyacrylamide, imidated polyacrylamide, casein, vinyl alcohol polymers containing urethane carboxylic groups or cyanoacetyl groups such as vinyl alcohol-vinyl cyanoacetate copolymer, polyvinyl alcohol-polyvinyl pyrrolidone, hydrolyzed polyvinyl acetate, polymers obtained by polymerization of proteins or saturated acylated proteins and monomers having vinyl groups, polyvinyl pyridine, polyvinylamine, polyaminoethyl methacrylate, polyethyleneimine and so on.

The emulsion of this invention can also contain various additives depending on the purpose. These additives may include for example, stabilizers or antifoggants such as azaindenes, triazoles, tetrazoles, imidazolium salts, tetrazolium salts, polyhydroxy compounds and others; film hardners such as of aldehyde type, zairidine type, inoxazole type, vinyl sulfone type, acryloyl type, alpodimide type, maleimide type, methane sulfonic acid ester type, triazine type, ec.; development accelerators such as benyl alcohol, polyoxyethylene type compounds, etc.; image stabilizers such as curomane type, cumarane type, bisphenole type, phosphite ester type, etc.; and lubricants such as wax, glyceride of higher fatty acid, higher alcohol ester of higher fatty acid. Also as surfactants for coating aids, permeability improving agents for processing liquids, defoaming agents or for controlling of various physical properties of sensitive materials, there may be employed various kinds of surfactants, including anion type, cation type, nonionic type or amphoteric type. As antistatic agents, there may effectively employed diacetyl cellulose, styrene-perfluoroalkyl sodium maleate copolymer, an alkali salt of a reaction product of styrene-maleic anhydride copolymer with p-aminobenzene sulfonic acid. As matting agents, there may be employed polymethyl methacrylate, polystyrene and alkali soluble polymers. Further, a colloidal silicon oxide may also be available. For the purpose of improving film properties, it is also possible to add a latex such as copolymers of acrylic acid esters or vinyl esters with other monomers having other ethylenic groups. As the gelatin plasticizer, there may be included glycerine, glycol type compounds; while the thickener may be inclusive of styrene-sodium maleate copolymer, alkyl vinyl ether-maleic acid copolymer and others.

As the support for the sensitive material prepared by use of the emulsion of this invention as prepared above, there are, for example, baryta paper, polyethylene coated paper, polypropylene synthetic paper, glass, cellulose acetate, cellulose nitrate, polyvinyl acetal, polypropylene, polyester films such as polyethyleneterephthalate, polystyrene and others, and these supports may be chosen depending on the respective intended uses of the silver halide sensitive materials.

These supports may also be applied with subbing treatment, if desired.

For obtaining characteristics with a broad latitude by use of the emulsion of this invention, at least two kinds of mono-dispersed emulsions with different mean diameters or different sensitivities can be mixed with each other or coated as multiple layers, whereby a sensitive material having abundant latitude can be obtained.

The sensitive material prepared by use of the emulsion of this invention can be subjected to the developing processing conventionally used after expoure to light.

The present invention is described in further detail by referring to the following Examples, by which the present invention is not limited.

EXAMPLE 1

By use of the seven kinds of solutions shown below, silver chlorobromide seed emulsions were prepared containing 70 mole % of silver bromide content.

| | |
|---|---|
| [Solution 1-A] | |
| Ossein gelatin | 40 g |
| Distilled water | 4000 ml |
| 10% Ethanolic aqueous solution of polyisoprene-polyethyleneoxydisuccinic acid sodium salt | 10 ml |
| $AgNO_3$ | 170 mg |
| 10% $H_2SO_4$ | 35 ml |
| [Solution 1-B] | |
| $AgNO_3$ | 23 g |
| Distilled water | make up to 1350 ml |
| [Solution 1-C] | |
| $AgNO_3$ | 577 g |
| Distilled water | make up to 1700 ml |
| [Solution 1-D] | |
| Ossein gelatin | 27 g |
| KBr | 11.9 g |
| NaCl | 2.37 g |
| 10% Ethanolic aqueous solution of polyisoprene-polyethyleneoxydisuccinic acid sodium salt | 5 ml |
| 10% $H_2SO_4$ | 19 ml |
| Distilled water | make up to 1340 ml |
| [Solution 1-E] | |
| Ossein gelatin | 33 g |
| KBr | 299 g |
| NaCl | 59.5 g |
| 10% Ethanolic aqueous solution of polyisoprene-polyethyleneoxydisuccinic acid sodium salt | 6 ml |
| 10% $H_2SO_4$ | 18.5 ml |

-continued

| | |
|---|---|
| Distilled water | make up to 1700 ml |
| [Solution 1-F] | |
| KBr | 2.20 g |
| NaCl | 115.8 g |
| Distilled water | make up to 2000 ml |
| [Solution 1-G] | |
| 7% Aqueous sodium carbonate solution | 208 ml |

At 40° C., by means of a stirring mixer as shown in Japanese Patent Applications No. 168193/1980 and No. 168194/1980, Solution 1-B and Solution 1-D were added to Solution 1-A over an addition time of 29.5 minutes according to the simultaneous mixing method. The addition rates were increased with the addition time in a zig-zag pattern as shown in Table 1. Two minutes after completion of addition, Solution 1-C and Solution 1-E were added according to the simultaneous mixing method over an addition time of 83 minutes.

The addition rates were increased with time as shown in Table 1. During addition of Solution 1-B and Solution 1-D, and of Solution 1-C and Solution 1-E, the pAg value in Solution 1-A was controlled to 4.0 (EAg value +340 mV) by use of Solution 1-F. Measurement of EAg value was conducted by use of a metallic silver electrode and a double-junction type saturated A/AgCl reference electrode. For addition of Solution 1-B, Solution 1-C, Solution 1-D, Solution 1-E and Solution of 1-F, a flow rate variable type roller tube metering pump was employed. Three minutes after completion of addition of Solution 1-C and Solution 1-E, EAg value was adjusted to +70 mV by addition of Solution 1-F. Further, 2 minutes later, Solution 1-G was added.

Next, according to the following procedures, washing with water and desalting were conducted. As precipitating agents, 650 ml of an aqueous 5% solution of Demol N produced by Kao-Atlas Co. and 650 ml of an aqueous 20% magnesium sulfate were added to form pricipitates, which were left to stand to be sedimented. After decantation of the supernatant, 7000 ml of distilled water was added to re-disperse the precipitates. Again precipitates were formed by addition of 200 ml of an aqueous 20% magnesium sulfate solution. After sedimentation of the precipitates, the supernatant was decanted and 500 ml of an aqueous ossein gelatin solution (containing 50 g of ossein gelatin) was added to the precipitates, followed by stirring at 55° C. for 30 minutes to effect dispersion, and then the total quantity was made up to 2500 ml with distilled water.

This emulsion is hereinafter called as "EM-1". This emulsion was found by electron microscope photograph to be a highly mono-dispersed emulsion consisting of cubic grains with a side length of 0.144 μm, with the standard deviation of the grain sizes being 6.8% of the mean grain diameter.

TABLE 1

| | Addition rate [ml/min.] | | | |
|---|---|---|---|---|
| Time (min.) | Soln. 1-B | Soln. 1-D | Soln. 1-C | Soln. 1-E |
| 0 | 10 | 9.7 | — | — |
| 3 | 10 | 9.7 | — | — |
| 5 | 15.9 | 15.4 | — | — |
| 7 | 22.7 | 22.0 | — | — |
| 10 | 36.4 | 35.3 | — | — |
| 12.5 | 50 | 48.5 | — | — |
| 15 | 63.6 | 61.7 | — | — |
| 29.5 | 63.6 | 61.7 | — | — |
| 31.5 | — | — | 3.64 | 3.56 |
| 40 | — | — | 5.45 | 5.35 |

TABLE 1-continued

| Time (min.) | Addition rate [ml/min.] Soln. 1-B | Soln. 1-D | Soln. 1-C | Soln. 1-E |
|---|---|---|---|---|
| 50 | — | — | 8.91 | 8.73 |
| 60 | — | — | 12.7 | 12.5 |
| 70 | — | — | 16.8 | 16.5 |
| 80 | — | — | 22.3 | 21.8 |
| 90 | — | — | 28 | 27.4 |
| 100 | — | — | 34.5 | 33.9 |
| 114.5 | — | — | 45 | 44.1 |

EXAMPLE 2

According to the same procedure as in Example 1, except for replacing [Solution 2-A]–[Solution 2-G] for [Solution 1-A]–[Solution 1-G], there was prepared a silver chlorobromide seed emulsion having 90 mol % of silver bromide content.

| | |
|---|---|
| [Solution 2-A] | |
| Ossein gelatin | 40 g |
| Distilled water | 4000 ml |
| 10% Ethanolic aqueous solution of polyisoprene-polyethyleneoxydisuccinic acid sodium salt | 10 ml |
| $AgNO_3$ | 170 mg |
| 10% $H_2SO_4$ | 35 ml |
| [Solution 2-B] | |
| $AgNO_3$ | 23 g |
| Distilled water | make up to 1350 ml |
| [Solution 2-C] | |
| $AgNO_3$ | 577 g |
| Distilled water | make up to 1700 ml |
| [Solution 2-D] | |
| Ossein gelatin | 27 g |
| KBr | 15.11 g |
| NaCl | 0.783 g |
| 10% Ethanolic aqueous solution of polyisoprene-polyethyleneoxydisuccinic acid sodium salt | 5 ml |
| 10% $H_2SO_4$ | 19 ml |
| Distilled water | make up to 1340 ml |
| [Solution 2-E] | |
| Ossein gelatin | 33 g |
| KBr | 371 g |
| NaCl | 19.87 g |
| 10% Ethanolic aqueous solution of polyisoprene-polyethyleneoxydisuccinic acid sodium salt | 6 ml |
| 10% $H_2SO_4$ | 18.5 ml |
| Distilled water | make up to 1700 ml |
| [Solution 2-F] | |
| KBr | 8.26 g |
| NaCl | 112.8 g |
| Distilled water | make up to 2000 ml |
| [Solution 2-G] | |
| 7% Aqueous sodium carbonate solution | 208 ml |

This emulsion is hereinafter called as "EM-2". This emulsion was found by electron microscope photograph to be a highly mono-dispersed emulsion consisting of cubic grains with a side length of 0.20 μm, with the standard deviation of the grain sizes being 7.6% of the mean grain diameter.

EXAMPLE 3

According to the same procedure as in Example 1, except for replacing [Solution 3-A] to [Solution 3-G] for [Solution 1-A] to [Solution 1-G], there was prepared a silver chlorobromide species emulsion having 60 mol % of silver bromide content.

| | |
|---|---|
| [Solution 3-A] | |
| Ossein gelatin | 40 g |
| Distilled water | 4000 ml |
| 10% Ethanolic aqueous solution of polyisoprene-polyethyleneoxydisuccinic acid sodium salt | 10 ml |
| $AgNO_3$ | 170 mg |
| 10% $H_2SO_4$ | 35 ml |
| [Solution 3-B] | |
| $AgNO_3$ | 23 g |
| Distilled water | make up to 1350 ml |
| [Solution 3-C] | |
| $AgNO_3$ | 577 g |
| Distilled water | make up to 1700 ml |
| [Solution 3-D] | |
| Ossein gelatin | 27 g |
| KBr | 10.07 g |
| NaCl | 3.13 g |
| 10% Ethanolic aqueous solution of polyisoprene-polyethyleneoxydisuccinic acid sodium salt | 5 ml |
| 10% $H_2SO_4$ | 19 ml |
| Distilled water | make up to 1340 ml |
| [Solution 3-E] | |
| Ossein gelatin | 33 g |
| KBr | 248 g |
| NaCl | 79.5 g |
| 10% Ethanolic aqueous solution of polyisoprene-polyethyleneoxydisuccinic acid sodium salt | 6 ml |
| 10% $H_2SO_4$ | 18.5 ml |
| Distilled water | make up to 1700 ml |
| [Solution 3-F] | |
| KBr | 1.42 g |
| NaCl | 116.2 g |
| Distilled water | make up to 2000 ml |
| [Solution 3-G] | |
| 7% Aqueous sodium carbonate solution | 208 ml |

This emulsion is hereinafter called as "EM-3". This emulsion was found by electron microscope photograph to be a highly mono-dispersed emulsion consisting of cubic grains with a side length of 0.144 μm, with the standard deviation of the grain sizes being 6.3% of the mean grain diameter.

EXAMPLE 4

By using the six kinds of the solutions as shown below, the seed emulsion prepared in Example 3 was grown to prepare a core/shell type mono-dispersed emulsion (Core=about 60 mole % of AgBr and about 40 mole % of AgCl; Shell=about 90 mole % of AgBr and about 10 mole % of AgCl).

| | |
|---|---|
| [Solution 4-A] | |
| Ossein gelatin | 31.9 g |
| Distilled water | 5666 ml |
| 10% Ethanolic aqueous solution of polyisoprene-polyethyleneoxydisuccinic acid sodium salt | 6.5 ml |
| EM-3 seed emulsion | 827.5 ml |
| [Solution - 4-B] | |
| $AgNO_3$ | 1000 g |
| Distilled water | make up to 1963 ml |
| [Solution 4-C] | |
| Ossein gelatin | 26.2 g |
| KBr | 295 g |
| NaCl | 91.76 g |
| 10% Ethanolic aqueous solution of polyisoprene-polyethyleneoxydisuccinic acid sodium salt | 2.62 ml |
| Distilled water | make up to 1308 ml |
| [Solution 4-D] | |
| Ossein gelatin | 13.1 g |

-continued

| | |
|---|---|
| KBr | 221.2 g |
| NaCl | 11.47 g |
| 10% Ethanolic aqueous solution of polyisoprene-polyethyleneoxydisuccinic acid sodium salt | 1.31 ml |
| Distilled water | make up to 654 ml |
| [Solution 4-E] | |
| KBr | 2.17 g |
| NaCl | 115.8 g |
| Distilled water | make up to 2000 ml |
| [Solution 4-F] | |
| KBr | 12.47 g |
| NaCl | 110.8 g |
| Distilled water | make up to 2000 ml |

At 60° C., by means of a stirring mixer as shown in Japanese Unexamined Patent Publication No. 92523/1982 and 92524/1982, Solution 4-B and Solution 4-c were added to Solution 4-A over an addition time of 42.8 minutes according to the simultaneous mixing method. After completion of the addition, subsequently Solution 4-B and Solution 4-D were added according to the simultaneous mixing method over an addition time of 12.69 minutes. The addition rates were changed with the addition time in a zig-zag pattern as shown in Table 2. During addition of each solution, the pAg value in Solution 4-A was controlled to to be maintained at 6.0 (EAg value +205 mV) by use of Solution 4-F (during addition of Solution 4-D). Measurement of pAg value was conducted according to the same method as described in Example 1.

For addition of Solution 4-B, Solution 4-C, Solution 4-D, Solution 4-E and Solution 4-F, a flow rate variable type roller tube metering pump was employed.

After completion of addition of Solution 4-C and Solution 4-D, washing with water and desalting were conducted. As precipitating agents, 1300 ml of an aqueous 5% solution of Demol N produced by Kao-Atlas Co. and 1300 ml of an aqueous 20% magnesium sulfate were added to form precipitates, which were left to stand to be sedimented. After decantation of the supernatant, 12300 ml of distilled water was added to re-disperse the precipitates. Again precipitates were formed by addition of 400 ml of an aqueous 20% magnesium sulfate solution. After sedimentation of the precipitates, the supernatant was decanted and 800 ml of an aqueous ossein gelatin solution (containing 80 g of ossein gelatin) was added to the precipitates, followed by stirring at 40° C. for 20 minutes to effect dispersion, and then the total quantity was made up to 5000 ml with distilled water. This emulsion is hereinafter called as "EM-4".

TABLE 2

| | Addition rate [ml/min.] | | |
|---|---|---|---|
| Time (min.) | Soln. 4-B | Soln. 4-C | Soln. 4-D |
| 0.00 | 17.52 | 16.64 | — |
| 2.73 | 18.94 | 17.99 | — |
| 5.27 | 20.30 | 19.29 | — |
| 7.65 | 21.61 | 20.53 | — |
| 12.01 | 24.13 | 22.92 | — |
| 17.78 | 27.68 | 26.30 | — |
| 22.88 | 31.01 | 29.46 | — |
| 27.46 | 34.17 | 32.46 | — |
| 31.65 | 37.19 | 35.33 | — |
| 36.74 | 41.03 | 38.98 | — |
| 40.26 | 43.80 | 41.61 | — |
| 42.80 | 45.88 | 43.59 | 43.59 |
| 46.69 | 49.09 | — | 46.63 |
| 51.55 | 53.28 | — | 50.62 |

TABLE 2-continued

| | Addition rate [ml/min.] | | |
|---|---|---|---|
| Time (min.) | Soln. 4-B | Soln. 4-C | Soln. 4-D |
| 55.49 | 56.77 | — | 53.93 |

COMPARATIVE EXAMPLE 1

As a comparative emulsion, the seed emulsion prepared in Example 1 was grown by use of the four kinds of solutions as shown below to prepare a mono-dispersed emulsion, having uniformly a silver bromide content of 70 mole % from the inner portion to the surface of the crystal.

| | |
|---|---|
| [Solution 5-A] | |
| Ossein gelatin | 31.9 g |
| Distilled water | 5666 ml |
| 10% Ethanolic aqueous solution of polyisoprene-polyethyleneoxydisuccinic acid sodium salt | 6.5 ml |
| EM-1 seed emulsion | 827.5 ml |
| [Solution 5-B] | |
| $AgNO_3$ | 1000 g |
| Distilled water | make up to 1963 ml |
| [Solution 5-C] | |
| Ossein gelatin | 39.3 g |
| KBr | 516.1 g |
| NaCl | 103.2 g |
| 10% Ethanolic aqueous solution of polyisoprene-polyethyleneoxydisuccinic acid sodium salt | 3.93 ml |
| Distilled water | make up to 1962 ml |
| [Solution 4-D] | |
| KBr | 3.36 g |
| NaCl | 115.2 g |
| Distilled water | make up to 2000 ml |

At 60° C., by means of a stirring mixer as shown in Japanese Unexamined Patent Publication No. 92523/1982 and 92524/1982, Solution 5-B and Solution 5-C were added to Solution 5-A over an addition time of 55.49 minutes according to the simultaneous mixing method. The addition rates were changed with the addition time in a zig-zag pattern as shown in Table 3. During addition of each solution, the pAg value in Solution 5-A was controlled to be maintained at 6.0 (EAg value +205 mV) by use of Solution 5-D.

tion 5-D, a flow rate variable type roller tube metering pump was employed.

ing pump was employed.

After completion of addition of Solution 5-C and Solution 5-D, desalting and re-dispersing steps were conducted according to the same methods as in Example 3. This emulsion is hereinafter called as "EM-5".

TABLE 3

| | Addition rate [ml/min.] | |
|---|---|---|
| Time (min.) | Soln. 5-B | Soln. 5-C |
| 0.00 | 17.52 | 16.64 |
| 2.73 | 18.94 | 17.99 |
| 5.27 | 20.30 | 19.29 |
| 7.65 | 21.61 | 20.53 |
| 12.01 | 24.13 | 22.92 |
| 17.78 | 27.68 | 26.30 |
| 22.88 | 31.01 | 29.46 |
| 27.46 | 34.17 | 32.46 |
| 31.65 | 37.19 | 35.33 |
| 36.74 | 41.03 | 38.98 |
| 40.26 | 43.80 | 41.61 |
| 42.80 | 45.88 | 43.59 |
| 46.69 | 49.09 | 46.63 |

TABLE 3-continued

| Time (min.) | Addition rate [ml/min.] Soln. 5-B | Soln. 5-C |
|---|---|---|
| 51.55 | 53.28 | 50.62 |
| 55.49 | 56.77 | 53.93 |

COMPARATIVE EXAMPLE 2

As a comparative emulsion, the seed emulsion prepared in Example 2 was grown by use of the four kinds of solutions as shown below to prepare a mono-dispersed emulsion, having uniformly a silver bromide content of 90 mole % from the inner portion to the surface of the crystal.

| | |
|---|---|
| [Solution 6-A] | |
| Ossein gelatin | 23.7 g |
| Distilled water | 4218 ml |
| 10% Ethanolic aqueous solution of polyisoprene-polyethyleneoxydisuccinic acid sodium salt | 6.5 ml |
| EM-2 seed emulsion | 2276 ml |
| [Solution 6-B] | |
| $AgNO_3$ | 653.8 g |
| Distilled water | make up to 1283 ml |
| [Solution 6-C] | |
| Ossein gelatin | 25.7 g |
| KBr | 433.9 g |
| NaCl | 22.5 g |
| 10% Ethanolic aqueous solution of polyisoprene-polyethyleneoxydisuccinic acid sodium salt | 2.57 ml |
| Distilled water | make up to 1283 ml |
| [Solution 6-D] | |
| KBr | 12.47 g |
| NaCl | 110.8 g |
| Distilled water | make up to 2000 ml |

This emulsion is hereinafter called as "Emulsion-6".

COMPARATIVE EXAMPLE 3

According to the same procedure as described in Example 2 in Japanese Patent Publication No. 36978/1975, a conversion method emulsion was prepared.

This emulsion is hereinafter called as "Emulsion-7".

EXAMPLE 5

According to the same procedure as in Example 4 by use of the same six kinds of the solutions as shown in Example 4, except that the solutions were added at the speeds maintained constantly as shown in Table 4, a poly-dispersed core/shell emulsion was prepared.

TABLE 4

| Time (min.) | Addition rate [ml/min.] Soln. 4-B | Soln. 4-C | Soln. 4-D |
|---|---|---|---|
| 0 | 10.0 | 9.50 | — |
| 130.8 | 10.0 | 9.50 | 9.50 |
| 196.3 | 10.0 | — | 9.50 |

This emulsion is hereinafter called as "Emulsion-8".

The results of observations by electron microscope of EM-1 to EM-8 are shown in Table 5.

TABLE 5

| Emulsion | | AgBr content | Mean diameter | Grain size distribution (coefficient of variance)* |
|---|---|---|---|---|
| EM-1 | Seed emulsion | 70 mole % | 0.144 μm | 6.8% |
| EM-2 | Seed emulsion | 90 mole % | 0.20 μm | 7.6% |
| EM-3 | Seed emulsion | 60 mole % | 0.144 μm | 6.3% |
| EM-4 | Core/shell mono-dispersed (Invention) | 70 mol % | 0.271 μm | 7.1% |
| EM-5 | Mono-dispersed (outside of Invention) | 70 mole % | 0.267 μm | 7.0% |
| EM-6 | Mono-dispersed (outside of Invention) | 90 mole % | 0.263 μm | 7.6% |
| EM-7 | Poly-dispersed, conversion method (outside of Invention) | — | 0.32 μm | 29% |
| EM-8 | Core/shell poly-dispersed (Invention) | 70 mole % | 0.265 μm | 7.1% |

*Coefficient of variance = percentage of standard deviation of grains size based on mean grain size

EXAMPLE 6

After 50 mg of a sensitizing dye (Compound A shown below) and 10 mg of a stabilizer (Compound B shown below) were added per mole of silver to each emulsion of EM-4 to EM-8, 5 mg of sodium thiosulfate was further added thereto, followed by optimum ripening at 50° C. to prepare each green-sensitive silver chlorobromide emulsion.

Next, separately, 2.5 g of a magenta coupler (Compound C shown below) was dissolved in a mixture of 2.5 ml of dibutyl phthalate and 7.5 ml of ethyl acetate under heating at 60° C., and the resultant solution was added to 70 ml of an aqueous solution containing 3.5 g of gelatin and 0.25 g of sodium dodecylbenzenesulfonate, followed by dispersing with vigorous stirring, to prepare an emulsified dispersion of a coupler.

Each of the above emulsions after ripening was divided into three aliquots, and:

(a) immediately after ripening, the above emulsified dispersion of coupler was mixed with the above-mentioned green-sensitive silver chlorobromide emulsion, 10 ml of a 3% methanol solution of 1,3,5-triacryloyl-hexahydro-S-triazine was added as a film hardener and the final pH was adjusted to 6.2, followed by coating of the mixture on a polyethylene resin coat paper to a silver amount of 0.3 g/m$^2$, a gelatin amount of 1.7 g/m$^2$ and a magenta coupler of 0.41 g/m$^2$ (80% of stoichiometric amount) (Sample No. 1a–5a);

(b) after ripening, when left to stand with stirring at 40° C. for 10 hours, the coupler dispersion and the film hardener were added, and coating was performed similarly as in the above (a) (Sample No. 1b–5b);

(c) after ripening, the above coupler dispersion was added, and thereafter the mixture was left to stand with stirring at 40° C. for 10 hours, followed by addition of the film hardener and coating (Sample No. 1c–5c).

Sensitizing dye (Compound A)

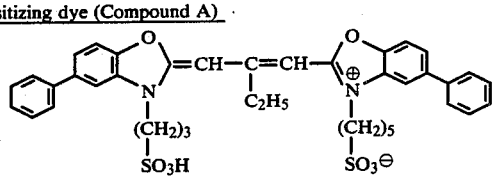

Stabilizer (Compound B)

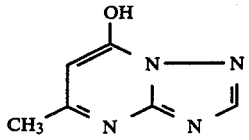

Magenta coupler (Compound C)

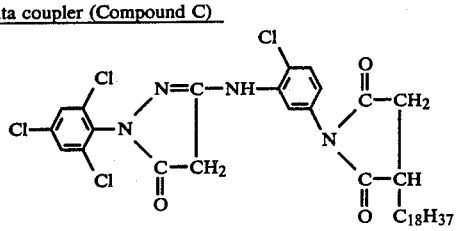

The above samples were each exposed to blue light through an optical wedge, and then subjected to the processings shown below, followed by measurements.

| [Processing step] | [Temperature] | [Time] |
|---|---|---|
| Color developing | 30° C. | 3 min. |
| Stopping | 30° C. | 1 min. |
| Fixing | 30° C. | 2 min. |
| Washing with water | 30° C. | 2 min. |
| Bleach-fixing | 30° C. | 2 min. |
| Washing with water | 30° C. | 2 min. |

| [Composition of color developer] | |
|---|---|
| Anhydrous sodium carbonate | 2.6 g |
| Anhydrous sodium bicarbonate | 3.5 g |
| Potassium sulfite | 18 g |
| Sodium chloride | 0.2 g |
| Potassium bromide | 1.3 g |

-continued

| | |
|---|---|
| Potassium hydroxide | 0.4 g |
| Hydroxyammonium sulfate | 2 g |
| 4-Amino-3-methyl-N—ethyl-N—(β-methanesulfonamidoethyl)-aniline | 5 g |
| Make up to one liter with water (pH 10.2) | |
| [Stopping solution] | |
| 2% Aqueous acetic acid solution | |
| [Fixing solution] | |
| Ammonium thiosulfate | 175.0 g |
| Anhydrous sodium sulfite | 8.6 g |
| Sodium metasulfite | 2.3 g |

Make up to one liter with addition of water and adjusted to pH 6.0 with acetic acid.

| [Bleach-fixing solution] | |
|---|---|
| Ammonium thiosulfate | 100 g |
| Potassium sulfite | 5 g |
| Na[Fe(EDTA)] | 40 g |
| EDTA | 4 g |
| Make up to one liter with water | |

The results of measurement are shown in Table 6.

Next, for Samples No. 1a–No. 5a, pressure desensitizing characteristics were examined. Pressure desensitizing characteristic was measured by scanning a needle with a round tip under a constant load on a coated sample, followed by exposure and development, and judging the extent of the image portion dropped off in white by observation with naked eyes. The results are shown in Table 7.

The developing characteristics were also tested with the use of the coated samples of No. 1a–No. 3a. After wedge exposure by use of the above color developer, the color development time was varied from 15 seconds to 3 minutes, and the minimum development time giving the same maximum density as the maximum density obtained by 3 minutes development is shown as the developing characteristic in Table 7. Since the development characteristic differs depending on the grain sizes of the silver halide grains, comparison was made between EM-4 to EM-6 with equal grain sizes.

TABLE 6

| | Emulsion | | | | Stability of coating solution | | |
|---|---|---|---|---|---|---|---|
| Sample No. | | Coefficient of variance | AgBr content | | a. coated immediately after addition of coupler dispersion | b. 10 hrs' elapse at 40° C. before addition of coupler dispersion | c. 10 hrs' elapse at 40° C. after addition of coupler dispersion |
| 1 | EM-4 (Invention) Mono-dispersed core/shell emulsion | 7.1% | 70 mole % | (Sensitivity) | 100 (Standard) | 101 | 96 |
| | | | | (Fog) | 0.02 | 0.02 | 0.03 |
| 2 | EM-5 (Control) Low AgBr emulsion | 7.0% | 70 mole % | (Sensitivity) | 100 (Standard) | 102 | 112 |
| | | | | (Fog) | 0.02 | 0.02 | 0.09 |
| 3 | EM-6 (Control) Mono-dispersed core/shell emulsion | 7.6% | 90 mole % | (Sensitivity) | 100 (Standard) | 100 | 94 |
| | | | | (Fog) | 0.02 | 0.02 | 0.03 |
| 4 | EM-7 (Control) Conversion method emulsion | 29% | — | (Sensitivity) | 100 (Standard) | 98 | 97 |
| | | | | (Fog) | 0.02 | 0.02 | 0.03 |
| 5 | EM-8 | 17.8% | 70 | (Sensi- | 100 (Stan- | 102 | 91 |

TABLE 6-continued

| Sample No. | Emulsion | Coefficient of variance | AgBr content | | Stability of coating solution: a. coated immediately after addition of coupler dispersion | b. 10 hrs' elapse at 40° C. before addition of coupler dispersion | c. 10 hrs' elapse at 40° C. after addition of coupler dispersion |
|---|---|---|---|---|---|---|---|
| | (Invention) Poly-dispersed core/shell emulsion | | mole % | tivity) (Fog) | dard) 0.02 | 0.02 | 0.04 |

Note
Coefficient of variance: Percentage of standard deviation of grain sizes based on mean grain size
Sensitivity: Dosage of exposure giving green light reflected density of 1.00
Fog: Green light reflected density

TABLE 7

| Sample No. | Pressure desensitizing performance and developing characteristic: Emulsion | AgBr content | Pressure densensitization | Developing characteristic* |
|---|---|---|---|---|
| 1 | EM-4 (Invention) Mono-dispersed core/shell emulsion | 70 mole % | Good | 1'30" |
| 2 | EM-5 (Control) Low AgBr emulsion | 70 mole % | Good | 1'30" |
| 3 | EM-6 (Control) High AgBr emulsion | 90 mole % | Good | 2'00" |
| 4 | EM-7 (Control) Conversion method emulsion | — | Poor | — |
| 5 | EM-8 (Invention) Poly-dispersed core/shell emulsion | 70 mole % | Good | — |

*Developing characteristic is the developing time before reaching the maximum density.

As apparently seen from the results in Table 6 and Table 7, the samples according to this invention exhibit good developing characteristics equal to that of Sample 5 of the mono-dispersed emulsion with low AgBr content, and the stability of fog under the state containing the coupler dispersion as excellent as the Sample 3 with higher AgBr content and the Sample 4 of the conversion method emulsion, and also free from pressure desensitization as observed in the Sample 4 of the conversion method emulsion, thus enabling stable commercial supply of sensitive materials capable of rapid development.

EXAMPLE 7

Example 6 was repeated except that the color developing which was carried out for 3 minutes in Example 6 was carried out for 9 minutes to compare the stability of fog (Sample No. 1' to 5'). Results are shown in Table 8.

TABLE 8

| Sample No. | Emulsion | Coefficient of variance | AgBr content | | Stability of coating solution: a. coated immediately after addition of coupler dispersion | b. 10 hrs' elapse at 40° C. before addition of coupler dispersion | c. 10 hrs' elapse at 40° C. after addition of coupler dispersion |
|---|---|---|---|---|---|---|---|
| 1' | EM-4 (Invention) Mono-dispersed core/shell emulsion | 7.1% | 70 mole % | (Sensitivity) (Fog) | 100 (Standard) 0.19 | 101 0.20 | 96 0.32 |
| 2' | EM-5 (Control) Low AgBr emulsion | 7.0% | 70 mole % | (Sensitivity) (Fog) | 100 (Standard) 0.22 | 102 0.25 | 112 0.94 |
| 3' | EM-6 (Control) Mono-dispersed core/shell emulsion | 7.6% | 90 mole % | (Sensitivity) (Fog) | 100 (Standard) 0.20 | 100 0.21 | 94 0.31 |
| 4' | EM-7 (Control) Conversion method | 29% | — | (Sensitivity) (Fog) | 100 (Standard) 0.20 | 98 0.21 | 97 0.33 |

TABLE 8-continued

| Sample No. | Emulsion | Coefficient of variance | AgBr content | | Stability of coating solution: a. coated immediately after addition of coupler dispersion | b. 10 hrs' elapse at 40° C. before addition of coupler dispersion | c. 10 hrs' elapse at 40° C. after addition of coupler dispersion |
|---|---|---|---|---|---|---|---|
| 5' | emulsion EM-8 (Invention) | 17.8% | 70 mole % | (Sensitivity) | 100 (Standard) | 102 | 91 |
| | Poly-dispersed core/shell emulsion | | | (Fog) | 0.22 | 0.23 | 0.44 |

Note
Coefficient of variance: Percentage of standard deviation of grain sizes based on mean grain size
Sensitivity: Dosage of exposure giving green light reflected density of 1.00
Fog: Green light reflected density

We claim:

1. A silver halide photographic emulsion containing a coupler for photography, comprising silver halide particles in said emulsion consisting essentially of 2 mole % or less of silver iodide, 50 to 97 mole % of silver bromide and 1 to 50 mole % of silver chloride, and said particles are core/shell type silver halide particles containing a higher content of said 50 to 97 mole % silver bromide in the surface layers of said particles than in the inner portions thereof, the surface layer of said particles containing 70 to 100 mole % of silver bromide and the inner portion containing 40 to 70 mole % of silver bromide.

2. The silver halide photographic emulsion according to claim 1, wherein said coupler is at least one coupler selected from the group consisting of yellow couplers, magenta couplers and cyan couplers.

3. The silver halide photographic emulsion according to claim 2, wherein said yellow coupler is an open-chain ketomethylene compound.

4. The silver halide photographic emulsion according to claim 2, wherein said magenta coupler is a pyrazolone type compound.

5. The silver halide photographic emulsion according to claim 2, wherein said cyan coupler is a phenol type compound.

6. The silver halide photographic emulsion according to claim 1, wherein said core/shell type silver halide particle has a shell thickness of from 0.01 to 0.2 μm.

7. The silver halide photographic emulsion according to claim 1, wherein said emulsion is a mono-dispersed emulsion.

8. The silver halide photographic emulsion according to claim 7, wherein said mono-dispersed emulsion has a coefficient of variance of 15% or less.

9. The silver halide photographic emulsion according to claim 1, wherein said emulsion is obtained by simultaneously adding and mixing an aqueous solution of a water soluble silver salt and an aqueous solution of a water soluble halide.

10. The silver halide photographic emulsion according to claim 9, wherein said solutions respectively contain silver ions and halide ions in equimolar ratio.

11. The silver halide photographic emulsion according to claim 1, wherein said emulsion is a mono-dispersed emulsion which has a coefficient of variance of 15% or less; and wherein said particles constituting said core/shell type silver halide particles have a shell thickness of from 0.01 to 0.2 μm.

12. The silver halide photographic emulsion according to claim 11, which contains at least one yellow coupler, at least one magenta coupler, and at least one cyan coupler.

13. The silver halide photographic emulsion according to claim 1, wherein said yellow coupler is an open-chain ketomethylene compound, said magenta coupler is a pyrazolone type compound and said cyan coupler is a phenol type compound.

14. The silver halide photographic emulsion according to claim 1, wherein said emulsion is obtained by simultaneously adding and mixing an aqueous solution of a water soluble silver salt and an aqueous solution of a water soluble halide and wherein said solutions respectively contain silver ions and halide ions in equimolar ratio.

15. The silver halide photographic emulsion according to claim 1, which contains at least one yellow coupler, at least one magenta coupler, and at least one cyan coupler.

16. The silver halide photographic emulsion according to claim 15, wherein said yellow coupler is an open-chain ketomethylene compound, said magenta coupler is a pyrazolone type compound and said cyan coupler is a phenol type compound.

17. The silver halide photographic emulsion according to claim 16, wherein said emulsion is obtained by simultaneously adding and mixing an aqueous solution of a water soluble silver salt and an aqueous solution of a water soluble halide and wherein said solutions respectively contain silver ions and halide ions in equimolar ratio.

* * * * *